US012532933B2

(12) United States Patent
Montgomery et al.

(10) Patent No.: US 12,532,933 B2
(45) Date of Patent: Jan. 27, 2026

(54) HAT BRIM TECHNOLOGY

(71) Applicant: Cover 22 LLC, Shreveport, LA (US)

(72) Inventors: Cassandra D. Montgomery, Shreveport, LA (US); Kenny A. Houston, Shreveport, LA (US); Thomas J. Walker, Los Angeles, CA (US)

(73) Assignee: Cover 22 LLC, Shreveport, LA (US)

( * ) Notice: Subject to any disclaimer, the term of this patent is extended or adjusted under 35 U.S.C. 154(b) by 0 days.

(21) Appl. No.: 18/669,428

(22) Filed: May 20, 2024

(65) Prior Publication Data

US 2024/0298730 A1 Sep. 12, 2024

Related U.S. Application Data

(63) Continuation of application No. 17/340,031, filed on Jun. 6, 2021, now Pat. No. 12,004,583, which is a continuation of application No. 16/112,591, filed on Aug. 24, 2018, now Pat. No. 11,026,463, which is a continuation-in-part of application No. 15/906,952, filed on Feb. 27, 2018, now Pat. No. 11,076,653, which is a continuation-in-part of application No. 29/615,668, filed on Aug. 30, 2017, now Pat. No. Des. 871,028, and a continuation-in-part of application No. 29/615,672, filed on Aug. 30, 2017, now Pat. No. Des. 843,694.

(60) Provisional application No. 62/635,415, filed on Feb. 26, 2018.

(51) Int. Cl.

| | |
|---|---|
| ***A42B 1/24*** | (2021.01) |
| ***A42B 1/004*** | (2021.01) |
| ***A42B 1/0182*** | (2021.01) |
| ***A42B 1/205*** | (2021.01) |
| ***A42B 1/248*** | (2021.01) |

(52) U.S. Cl.

CPC ..... *A42B 1/248* (2013.01); *A42B 1/004* (2013.01); *A42B 1/0182* (2021.01); *A42B 1/205* (2013.01)

(58) Field of Classification Search

CPC ..... A42B 1/248; A42B 1/004; A42B 1/062; A42B 1/208

See application file for complete search history.

(56) References Cited

U.S. PATENT DOCUMENTS

| | | | | |
|---|---|---|---|---|
| 1,274,652 | A | 8/1918 | Winget | |
| 1,753,052 | A * | 4/1930 | Lake, Jr. | A42B 1/02 2/195.7 |
| D111,267 | S | 9/1938 | Scheiwiller | |
| 2,377,645 | A | 6/1945 | Peffer | |
| 2,416,062 | A | 2/1947 | Mercer | |
| 2,803,829 | A | 8/1957 | Tscharner | |
| D248,893 | S | 8/1978 | Comensoli et al. | |
| 4,292,689 | A | 10/1981 | Townsend, Jr. | |

(Continued)

*Primary Examiner* — Gary C Hoge

(74) *Attorney, Agent, or Firm* — Wright IP & International Law; Eric G. Wright

(57) ABSTRACT

A hat brim technology for framing one or more brim opening in a hat brim. A brim clip which engages at least a portion of a brim opening and which can optionally secure a number of brim material layers when in an installed state. A method for creating a framed brim opening in a hat brim. A cap including at least one panel and a brim having an opening in a shape of at least one of an advertisement, a logo, a design, a statement, a phrase, an emblem of a sports team, company, or organization.

3 Claims, 16 Drawing Sheets

(56) References Cited

U.S. PATENT DOCUMENTS 4,335,471 A 6/1982 Quigley, Jr. et al.
4,546,496 A * 10/1985 Lewis ..... A42C 5/04 2/436
4,945,575 A 8/1990 Townsend
5,253,368 A 10/1993 Blake
5,275,419 A 1/1994 Kazemi
D349,596 S 8/1994 Booth
5,410,761 A * 5/1995 Connelly ..... A42B 1/248 40/329
5,425,620 A * 6/1995 Stroud ..... A42C 5/04 403/360
5,465,426 A 11/1995 Beaton
5,487,191 A * 1/1996 Ridley ..... A42C 5/04 2/10
D369,096 S 4/1996 Perrin et al.
5,548,847 A 8/1996 Spicijaric
D374,331 S 10/1996 Duggan
5,647,060 A 7/1997 Lee
5,729,833 A 3/1998 Judge
5,742,944 A 4/1998 Pfefferman
5,815,841 A * 10/1998 Spangrud ..... A42B 1/004 2/209.13
D400,341 S 11/1998 House
5,920,913 A * 7/1999 Brandon ..... A63B 71/143 2/209.12
5,943,698 A 8/1999 Blanks, I
6,044,492 A 4/2000 Krogh
D430,403 S 9/2000 Baik
6,170,088 B1 * 1/2001 Tate ..... A63B 57/35 2/200.1
6,240,568 B1 6/2001 Lee
6,418,562 B1 * 7/2002 Shwartz ..... A42B 1/248 40/329
6,457,183 B1 * 10/2002 Perry, Sr. ..... A42B 1/24 2/209.12
6,470,499 B1 10/2002 Joiner
6,986,166 B2 1/2006 Cho
D550,931 S * 9/2007 Valcourt ..... D2/866
7,454,799 B2 11/2008 Wuensche et al.
D592,835 S 5/2009 Wilson
D601,329 S 10/2009 Johns
D617,981 S * 6/2010 Hines ..... D2/893
D622,488 S 8/2010 McClaskie
D622,491 S 8/2010 McClaskie
D641,424 S 7/2011 Bengyak
8,726,420 B1 5/2014 Uitermarkt
8,763,163 B1 * 7/2014 Johns ..... A42B 1/22 2/200.1
D741,050 S 10/2015 Bell
D843,694 S 3/2019 Houston et al.
D849,370 S 5/2019 Garcia et al.
D871,028 S 12/2019 Houston et al.
11,076,653 B2 8/2021 Houston et al.
12,004,583 B2 6/2024 Montgomery et al.
2004/0079011 A1 4/2004 Schwartz et al.
2004/0231033 A1 * 11/2004 Cho ..... A42B 1/0182 2/195.1
2006/0117462 A1 6/2006 Wysopal
2007/0006502 A1 1/2007 Schmelzer et al.
2007/0022516 A1 * 2/2007 Wuensche ..... A42B 1/225 2/172
2007/0061937 A1 3/2007 Curle
2007/0271679 A1 11/2007 Wysopal
2008/0072466 A1 3/2008 Fenner
2008/0222777 A1 * 9/2008 Schneider ..... A42B 1/008 2/209.13
2009/0100559 A1 * 4/2009 Christian ..... A42B 1/248 2/244
2010/0299979 A1 12/2010 LaMere
2011/0067168 A1 * 3/2011 Steiner ..... A42B 1/0182 2/175.1
2012/0096625 A1 4/2012 Sarazin
2014/0304889 A1 10/2014 Oh
2015/0033444 A1 * 2/2015 Heard ..... A42B 1/22 2/209.12
2015/0164167 A1 * 6/2015 Gayer ..... A42B 1/006 2/195.1
2016/0219962 A1 * 8/2016 Abers ..... A42B 1/245
2019/0059489 A1 2/2019 Houston et al.
2021/0289871 A1 9/2021 Montgomery et al.

* cited by examiner

HAT BRIM TECHNOLOGY

CROSS REFERENCE TO RELATED APPLICATIONS

This patent application is a nonprovisional US patent application of and claims benefit of copending U.S. provisional patent application No. 62/635,415 titled "Hat Brim Technology" filed Feb. 26, 2018.

This patent application is also a continuation in part application of and claims benefit of the filing date of copending U.S. application Ser. No. 15/906,952 titled "Hat Showing A Message Or A Logo Through A Cutout" filed Feb. 27, 2018, which is a continuation in part application of and claims the benefit of copending U.S. design patent application Ser. No. 29/615,668 titled "Gun Hat" filed Aug. 30, 2017 and which is also a continuation in part application of and claims the benefit of copending U.S. design patent application Ser. No. 29/615,672 titled "Leaf Hat" filed on Aug. 30, 2017.

Thus, this application claims benefit of the filing dates of copending U.S. provisional application No. 62/635,415 filed Feb. 26, 2018, copending U.S. nonprovisional patent application Ser. No. 15/906,952 filed Feb. 27, 2018, copending U.S. design patent application Ser. No. 29/615,668 filed Aug. 30, 2017 and copending U.S. design patent application Ser. No. 29/615,672 filed on Aug. 30, 2017.

The benefit of the filing dates of U.S. design patent application Ser. No. 29/615,668 filed Aug. 30, 2017 and U.S. design patent application Ser. No. 29/615,672 filed on Aug. 30, 2017 are claimed through U.S. nonprovisional patent application Ser. No. 15/906,952 filed Feb. 27, 2018 to which benefit is claimed.

INCORPORATION BY REFERENCE

This patent application also incorporates by reference in its entirety copending U.S. provisional patent application No. 62/635,415 titled "Hat Brim Technology" filed Feb. 26, 2018 in its entirety.

This patent application also incorporates by reference in its entirety copending U.S. application Ser. No. 15/906,952 titled "Hat Showing A Message Or A Logo Through A Cutout" filed Feb. 27, 2018, which incorporates by reference in its entirety copending U.S. design patent application Ser. No. 29/615,668 titled "Gun Hat" filed Aug. 30, 2017 and which incorporates by reference in its entirety copending U.S. design patent application Ser. No. 29/615,672 titled "Leaf Hat" filed on Aug. 30, 2017, each of which are entirely incorporated by reference herein.

Thus, this application incorporates by reference in its entirety each of the following copending applications: U.S. provisional application No. 62/635,415 filed Feb. 26, 2018; U.S. nonprovisional patent application Ser. No. 15/906,952 filed Feb. 27, 2018; U.S. design patent application Ser. No. 29/615,668 filed Aug. 30, 2017; and U.S. design patent application Ser. No. 29/615,672 filed on Aug. 30, 2017.

FIELD OF THE INVENTION

This disclosure regards a hat brim technology. Further, the present disclosure regards a hat or a cap that comprises and/or displays a shape and/or an insignia, such as an advertisement, logo, design, or an emblem of a sports team, a company, or an organization, through a cutout in the brim, visor, or bill portion of the hat or cap.

SUMMARY OF THE INVENTION

In an embodiment a hat can have a hat brim having a brim opening, the brim opening can have an upper layer perimeter; and an upper brim clip portion which frames at least a portion of the upper layer perimeter. The hat can also have a lower brim clip portion which frames at least a portion of a lower layer perimeter of the opening. Further, the hat can have a lower brim clip portion which frames at least a portion of a lower layer perimeter of the opening and which at least in part secures the upper layer perimeter in position in relation to the upper layer perimeter.

The lower brim clip can at least in part secure the upper brim clip in position in relation to the upper layer perimeter. The upper brim clip can at least in part secure an upper layer in position in relation to a different layer. Additionally, the lower brim clip portion can at least in part secure the upper brim clip in position in relation to an upper layer perimeter.

In an embodiment, the hat can have a lower brim clip portion which at least in part can secure the upper brim clip in position in relation to the upper layer perimeter; and the upper brim clip portion and the lower brim clip portion can secure a plurality of layers of material of the hat brim in position in regard to one another.

In another embodiment, the hat brim clip can have an upper brim clip portion configured adjacent to an upper brim portion and a lower brim clip portion configured adjacent to an upper brim portion. The upper brim clip portion and the lower brim clip portion can be secured in position in relation to one another by at least one lock prong.

In an embodiment a hat brim clip can have a plurality of lock prongs. The hat brim clip can also have a plurality of lock prongs forming a locking comb. A hat brim clip can have a first lock prong which is different than a second lock prong. A hat brim clip can have a lock prong extending from the upper brim clip portion. A hat brim clip can have a lock prong extending from the lower brim clip portion. A hat brim clip can have a lower brim clip portion having a lock surface that is engaged with a lock prong when in an installed state in a hat brim.

A hat brim clip can have a lock prong having a lock angle forming a lock claw portion of the lock prong and the lock claw can engage at least a portion of the lock surface when in an installed state in a hat brim.

A method for producing a framed brim opening can have the following method steps: providing a hat having a hat brim; cutting an opening in the hat brim; the cutting creating an opening having a shape and an upper layer perimeter; providing an upper brim frame having at least a portion of which is configured adjacent to the upper layer perimeter; securing the upper brim frame adjacent to an upper portion of the upper brim; and the securing producing a framed hat brim opening.

The method for producing a framed brim opening can have the hat brim having a plurality of material layers. The method for producing a framed brim opening can have the following method steps: providing a lower brim frame; and configuring the lower brim frame adjacent to a lower portion of the brim.

In an embodiment of the method for producing a framed brim opening, the upper brim frame and the lower brim frame can be different at least in part. In another embodiment, the method for producing a framed brim opening the shape of the upper brim frame and the upper layer perimeter can be different at least in part.

In an embodiment, a brim frame for a brim opening can have a frame portion configured adjacent to a brim portion which frames at least a portion of a brim opening.

The brim frame for a brim opening can have the brim portion having an upper brim portion and the frame portion is an upper frame portion. The brim frame for a brim opening can have the brim portion having an upper brim portion and the frame portion is a lower frame portion. A hat brim clip can have at least a portion of the upper brim clip has a different shape than at least a portion of the lower brim clip.

In an embodiment a cap can have at least one panel and a brim having an opening in a shape of at least one of an advertisement, a logo, a design, a statement, a phrase, an emblem of a sports team, company, or organization.

In an embodiment, the cap can have the brim opening positioned off-center of the brim. In another embodiment, the cap can have the brim opening having a depth that is the same as the thickness of the brim, and can penetrate though the brim completely.

The brim can create a shaded area that covers at least a portion of the user's face and wherein the brim opening is positioned such that light passing through the brim opening creates an image of the brim opening on the face of the user. In an embodiment, the brim opening is in a shape of a handgun. In another embodiment, the brim opening is in a shape of a cannabis leaf, also herein as a marijuana leaf. In yet another embodiment, the at least one panel includes at least a statement and a design.

In an embodiment, the at least one panel includes at least one of an advertisement, a logo, a design, a statement, a phrase, an emblem of a sports team, company, or organization that is in a shape of the brim opening.

In an aspect, a cap includes at least one panel and a brim having an opening in a shape of at least one of an advertisement, a logo, a design, a statement, a phrase, an emblem of a sports team, company, or organization.

BACKGROUND

Hat brims can have more than one layer of material. When a hat brim is cut to create an opening, the structural integrity of the hat brim can be destroyed.

BRIEF DESCRIPTION OF THE DRAWINGS

The present technology in its several aspects and embodiments solves the problems discussed above and significantly advances the technology of hat 10 manufacturing technology. The present technology can become more fully understood from the detailed description and the accompanying drawings, wherein.

Herein, like reference numbers in one figure refer to like reference numbers in another figure.

DETAILED DESCRIPTION

Figure 1:
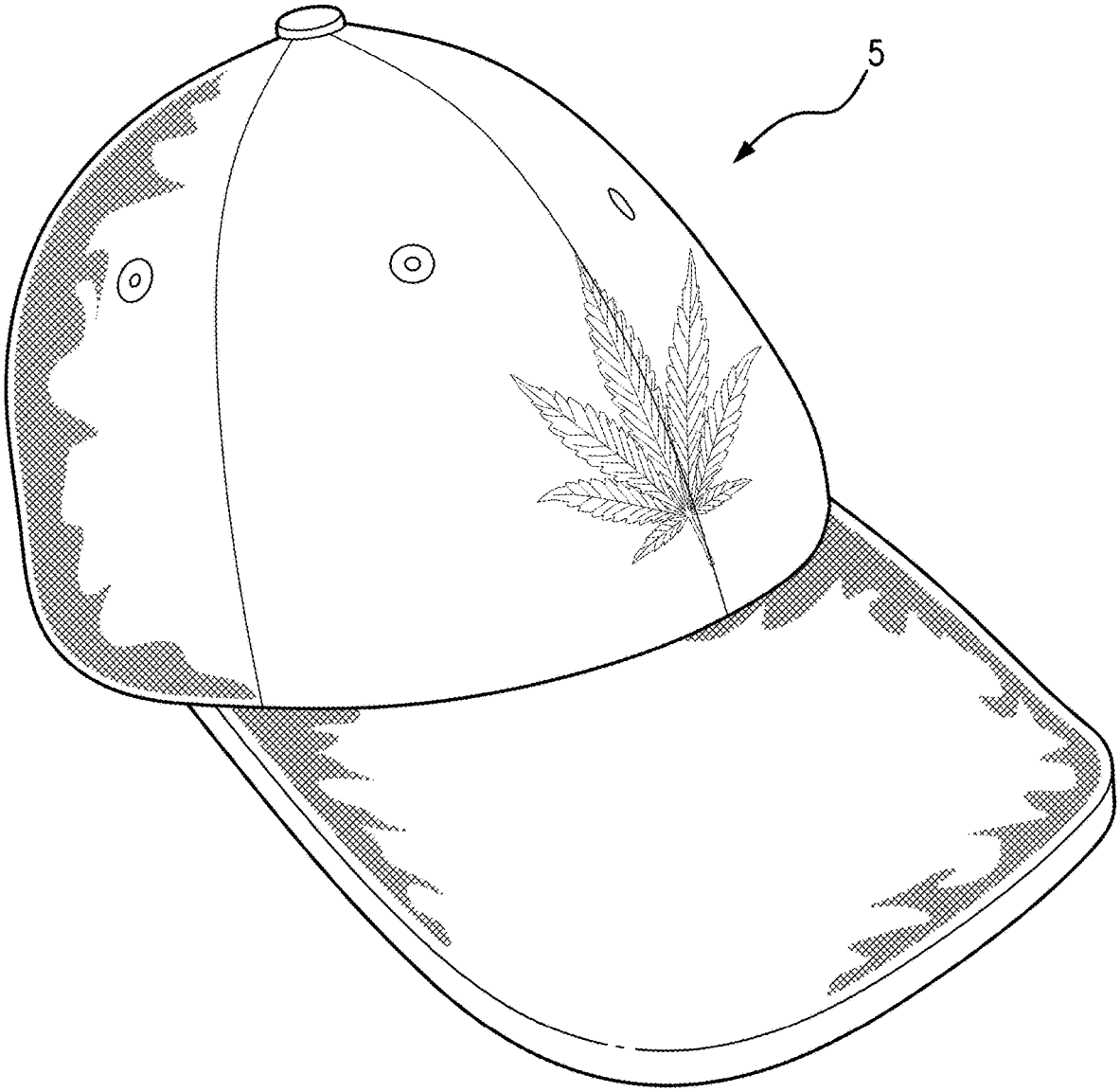
FIG. 1 PRIOR ART
FIG. 1 shows a prior art hat.

This disclosure relates to the many and varied embodiments of a hat brim technology. FIG. 1 shows a prior art hat 5 having a solid and complete hat brim.

It is to be understood that both the foregoing general description and the following detailed description are exemplary and explanatory only, and are intended to provide an explanation of various embodiments of the present teachings. In the drawings and in the description that follows, the terms "hat brim", "brim," "visor," or "bill" refer to the portion of the cap that protrudes outward to for nonlimiting example shade the eyes from sunlight and/or to keep rain off at least a portion of the face and are used interchangeably.

Figure 2:
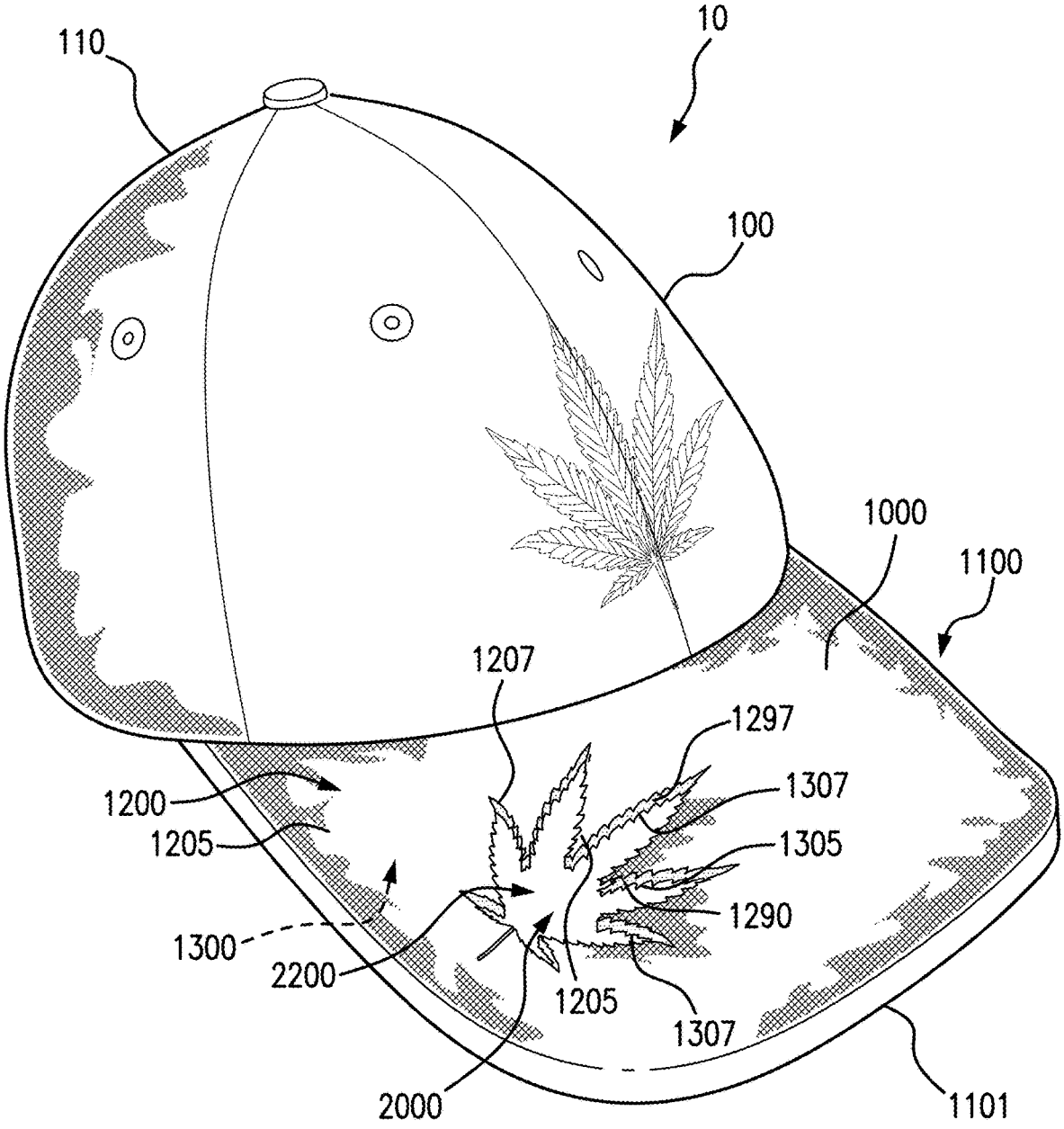
FIG. 2 shows a hat having a brim opening in the shape of a leaf.

FIG. 2 shows a hat having a brim opening in the shape of a leaf.

FIG. 2 shows an embodiment of a hat 10, which is a non-limiting example of a baseball cap 110, having a hat brim 1000. FIG. 2 also shows the hat 10 having a hat brim 1000 having a brim opening 2000 that has a brim perimeter 1100.

Numeric values and ranges herein, unless otherwise stated, also are intended to have associated with them a tolerance and to account for variances of design and manufacturing. Thus, a number can include values "about" that number. For example, a value X is also intended to be understood as "about X". Likewise, a range of Y-Z, is also intended to be understood as within a range of from "about Y-about Z". Unless otherwise stated, significant digits disclosed for a number are not intended to make the number an exact limiting value. Variance and tolerance is inherent in mechanical design and the numbers disclosed herein are intended to be construed to allow for such factors (in non-limiting e.g., ±10 percent of a given value). Likewise, the claims are to be broadly construed in their recitations of numbers and ranges.

In the embodiment of FIG. 2, the brim opening 2000 has an opening shape 2200. In the example of FIG. 2, the opening shape is in the form of a leaf, i.e. a marijuana leaf.

Figure 12:
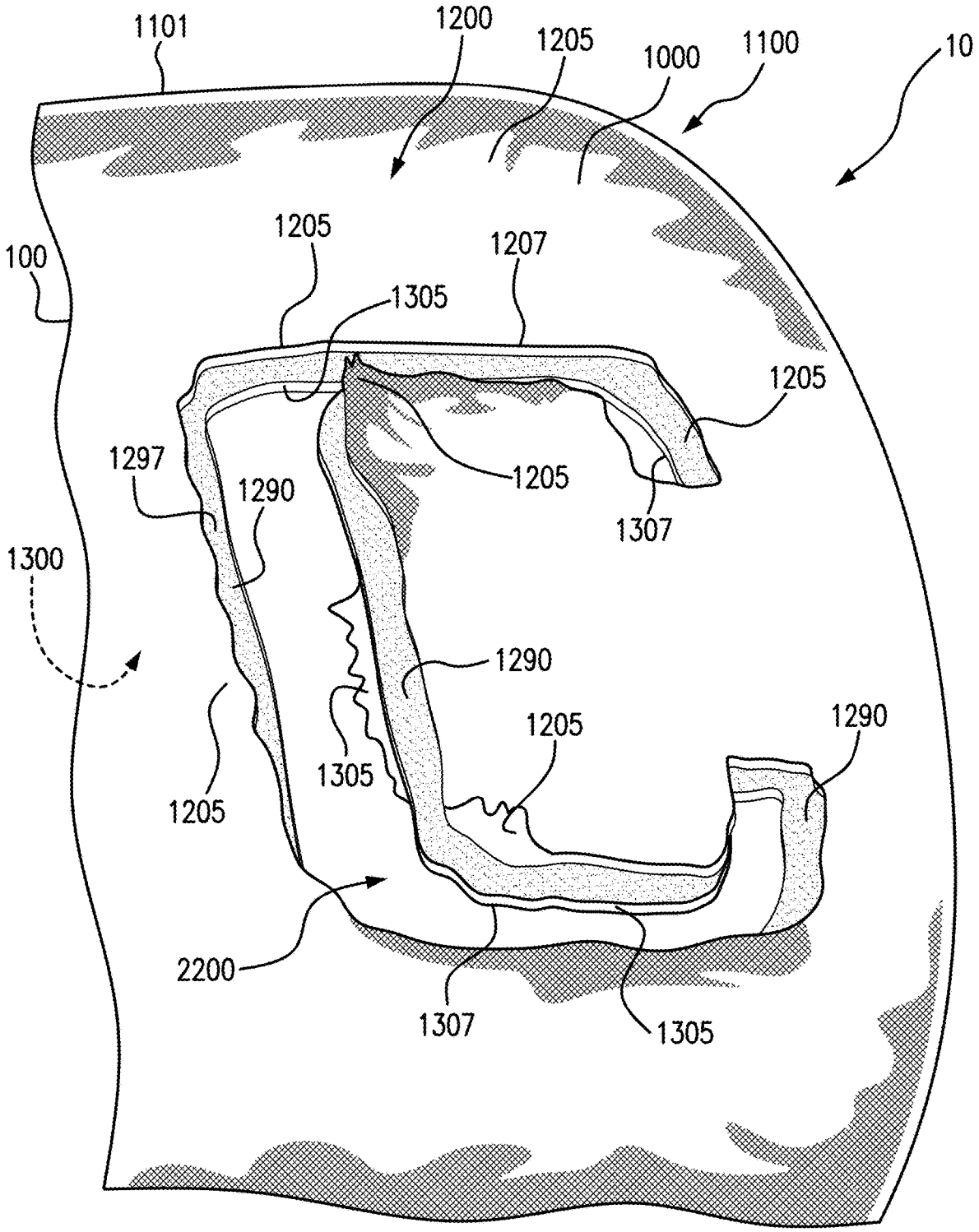
FIG. 12 shows a hat having a brim opening in the shape of a the letter "C"

However, as shown in FIG. 12, the opening shape 2200 is in the form of a letter "C". There is no limitation to the variety of shapes that opening shape 2200 can have. Additionally, a hat 10 can have a number of the brim opening 2200, e.g. in a range of 1 . . . n, where n is a large number. For example, the have can have a number of brim openings in a range of from 1 to 2, or 1 to 4, or 1 to 10, or 1 to 20, or 1 to 100.

In the example cap 100, of FIG. 2, the hat brim 1000 has an upper brim portion 1200 having a upper layer 1205 which has an upper layer opening perimeter 1207, and a lower brim portion 1300 having a lower layer 1305 which has a lower layer opening perimeter 1307.

The upper layer 1205 and the lower layer 1305 can be separated by a middle layer 1290 having a middle layer opening perimeter 1297.

The hat brim 1000 can also have a brim outer perimeter 1100 having a brim edge 1101.

In an embodiment, the brim opening 2000 could have a framed film, screen, layer, membrane or member which spans at least a part, or all of the brim opening 2000.

Figure 3:
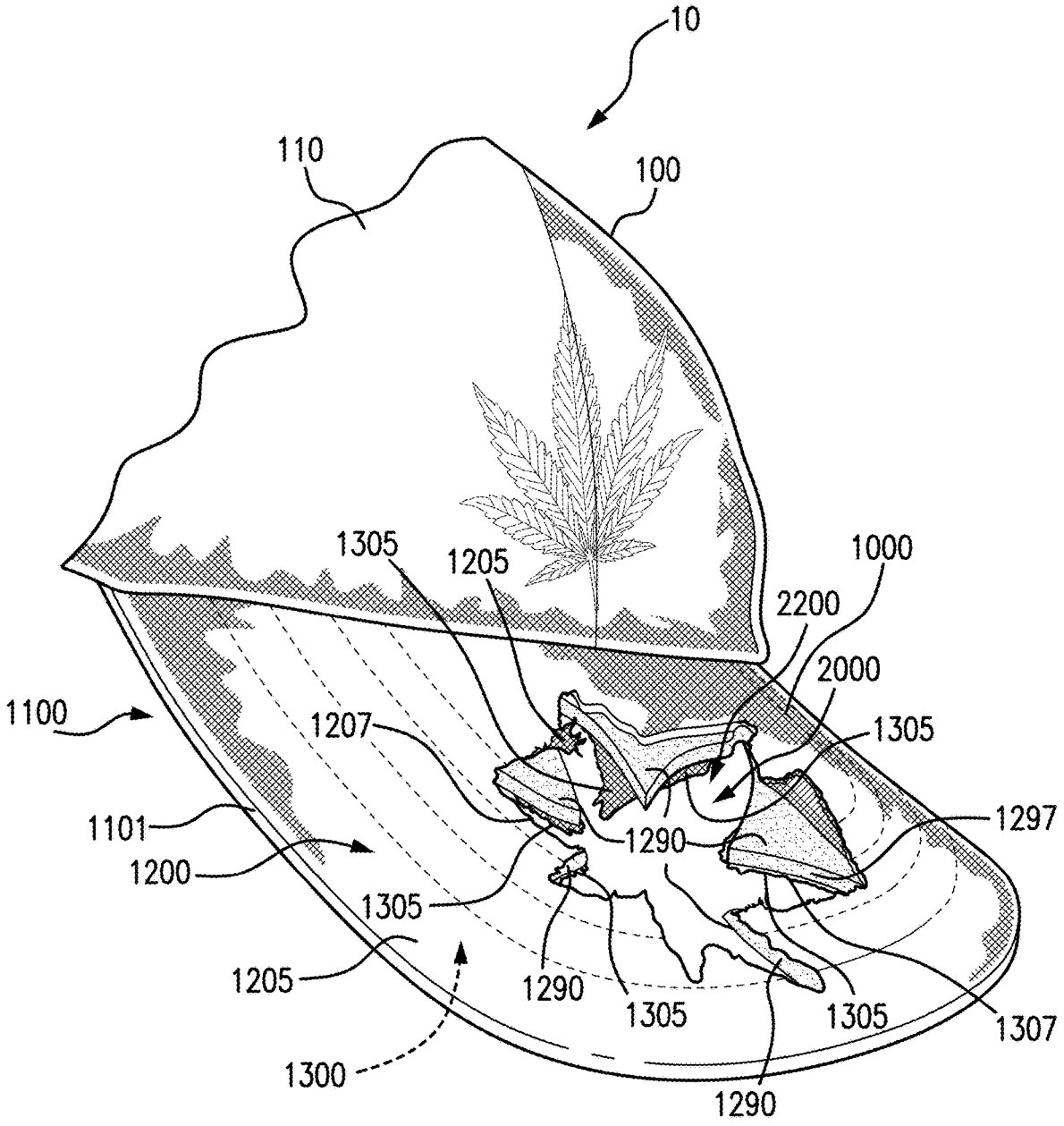
FIG. 3 shows and upper view of the hat having and opening in which integrity of the brim was destroyed by the process of creating the brim opening.

FIG. 3 shows and upper view of the hat having and opening in which integrity of the brim was destroyed by the process of creating the brim opening. When a hat brim is penetrated, cut stamped, sawn, torn, ripped, or otherwise operated upon, to create a brim opening 2000, the integrity of the configuration of the brim components can be destroyed. As shown in FIG. 3, the upper layer 1205 is separating from the middle layer 1290 and the lower layer 1305 is separating from the middle layer 1290.

In one aspect of destruction the cutting of the upper layer 1205 causes the upper layer 1205 to deform and lose its integrity and shape, e.g. a fabric form an upper layer 1205 by being configured across the brim's middle layer surface. Optionally, the upper layer 1205 can be sown to the middle layer 1290 and when the brim opening 2000 is formed the stitching is cut in addition to the hat brim 1000 and its upper layer 1205.

FIG. 3 shows examples of the deformation of portions of upper layer 1205 proximate to the brim opening 2000. FIG. 3 also shows examples of the deformation of portions of lower layer 1305 proximate to the brim opening 2000.

FIG. 3 also shows the middle layer 1290 having a middle layer opening perimeter 1297.

Figure 4:
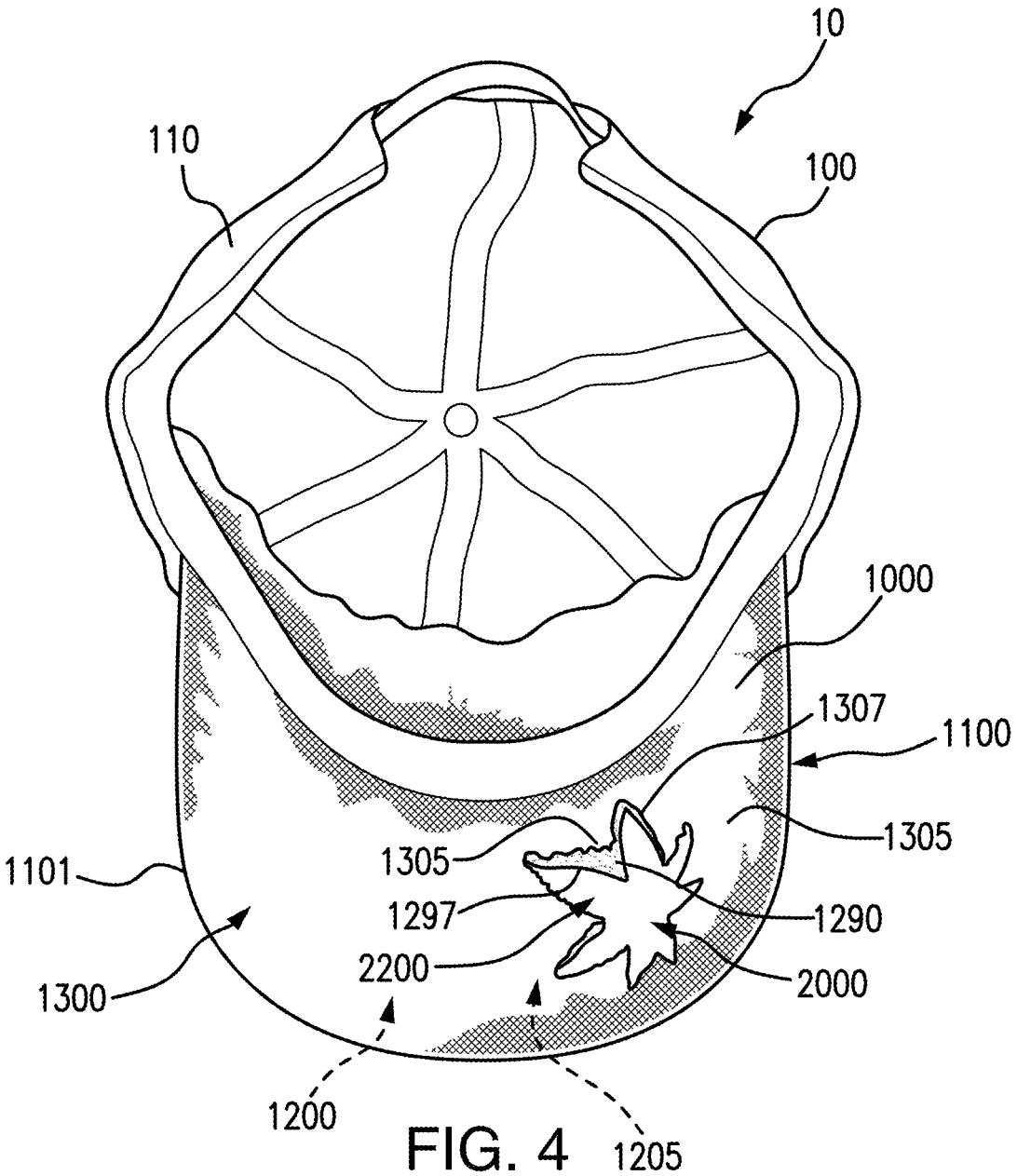
FIG. 4 shows a lower view of the hat having and opening in which integrity of the brim was destroyed by the process of creating the brim opening.

FIG. 4 shows a lower view of the hat having and opening in which integrity of the brim was destroyed by the process of creating the brim opening.

FIG. 4 shows a portion of lower layer 1305 separating from a portion of the middle layer 1290.

Figure 5:
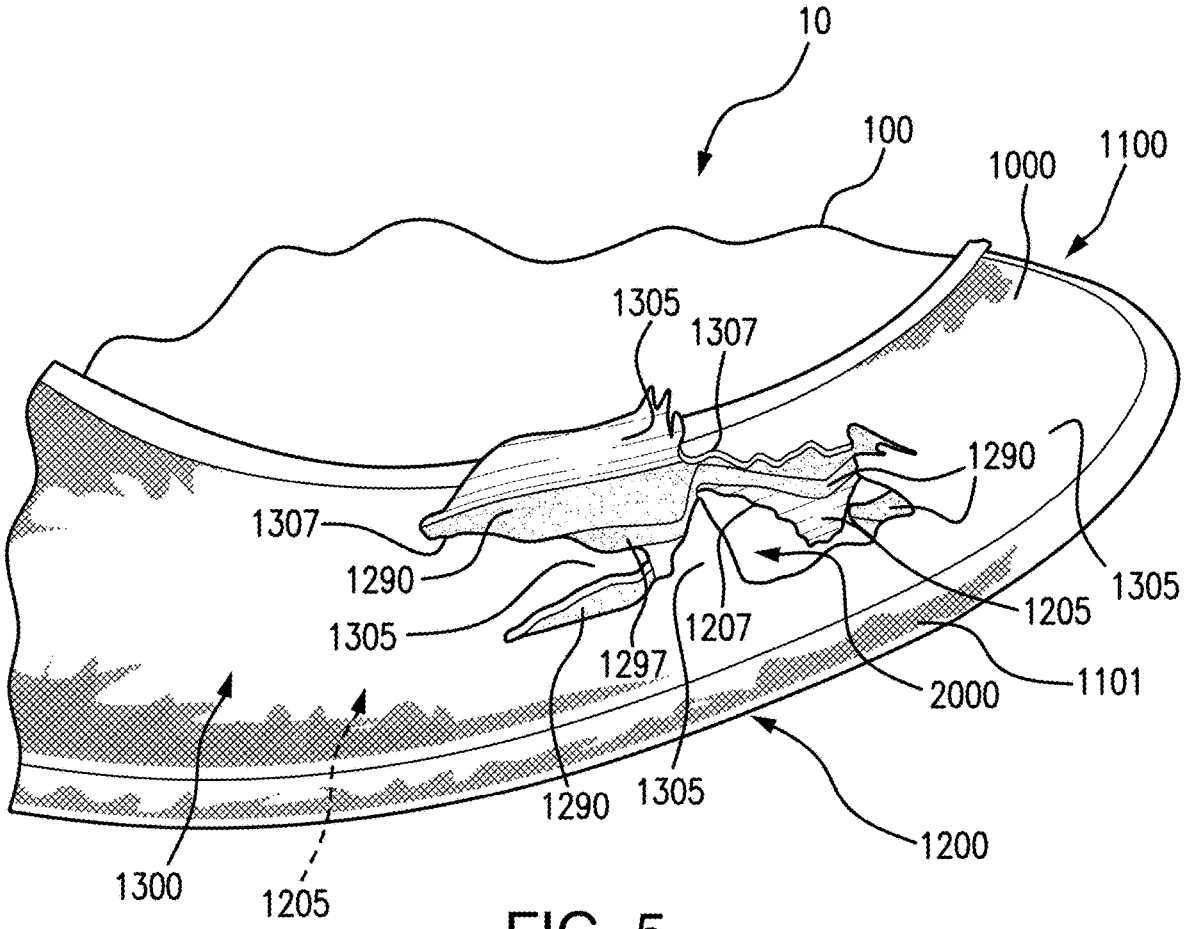
FIG. 5 is a perspective view showing a separation of portions of the upper layer from the middle layer and the lower layer from the middle layer which can result from the destruction of the process of creating the brim opening.

FIG. 5 is a perspective view showing a separation of a number of portions of the upper layer 1205 from the middle layer 1290 and the lower layer 1305 from the middle layer 1290 which can result from the destruction of the hat brim 1000 during or as a result of the process of creating the brim opening 2000.

Figure 6:
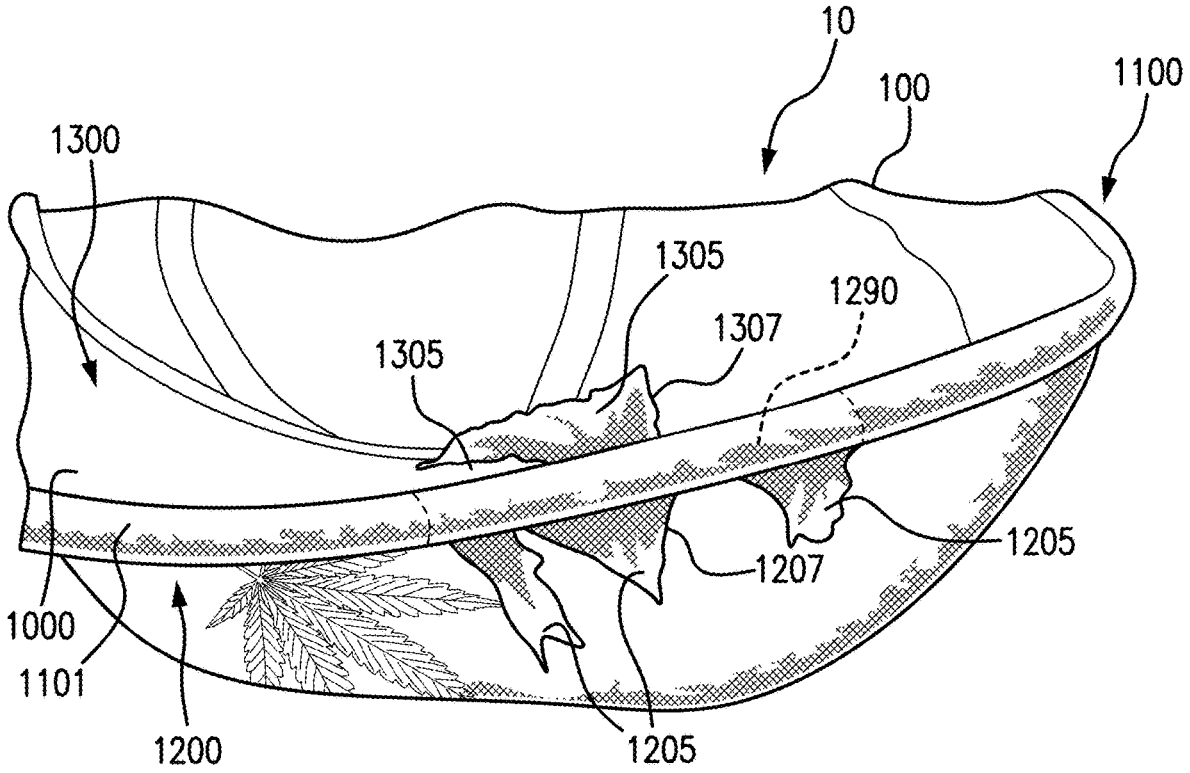
FIG. 6 is a brim edge view showing the separation of portions of the upper layer from the middle layer and the lower layer from the middle layer which can result from the destruction of the process of creating the brim opening.

FIG. 6 is a brim edge view showing the separation of portions of the upper layer 1205 from the middle layer 1290 and the lower layer 1305 from the middle layer 1290 which can result from the destruction of the hat brim 1000 during or as a result of the process of creating the brim opening 2000.

Figure 7:
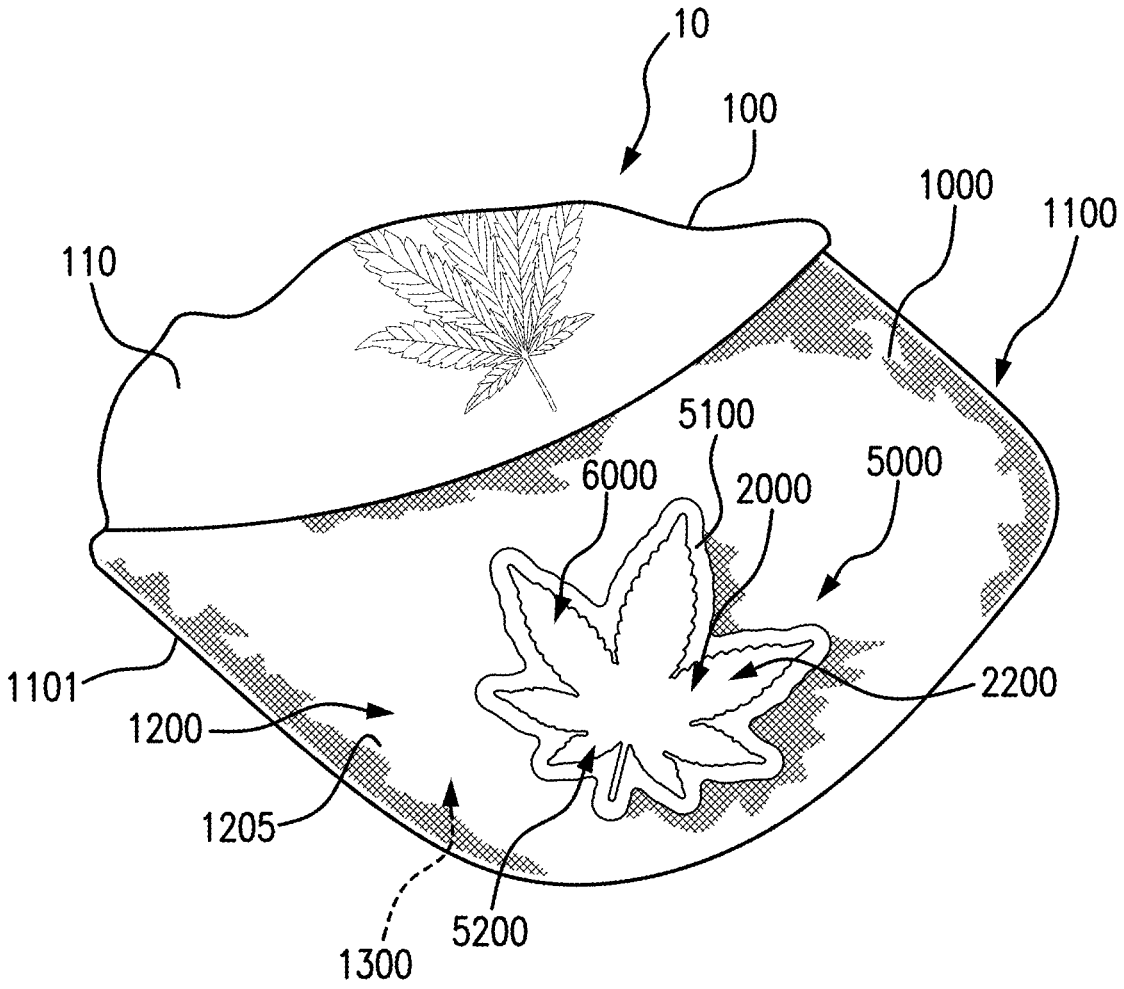
FIG. 7 shows a hat brim having a brim opening framed by an upper brim frame.

FIG. 7 shows a hat brim 1000 having a brim opening 2000 having opening shape 2200 framed by an upper brim frame 5100 having opening 6000.

Figure 8:
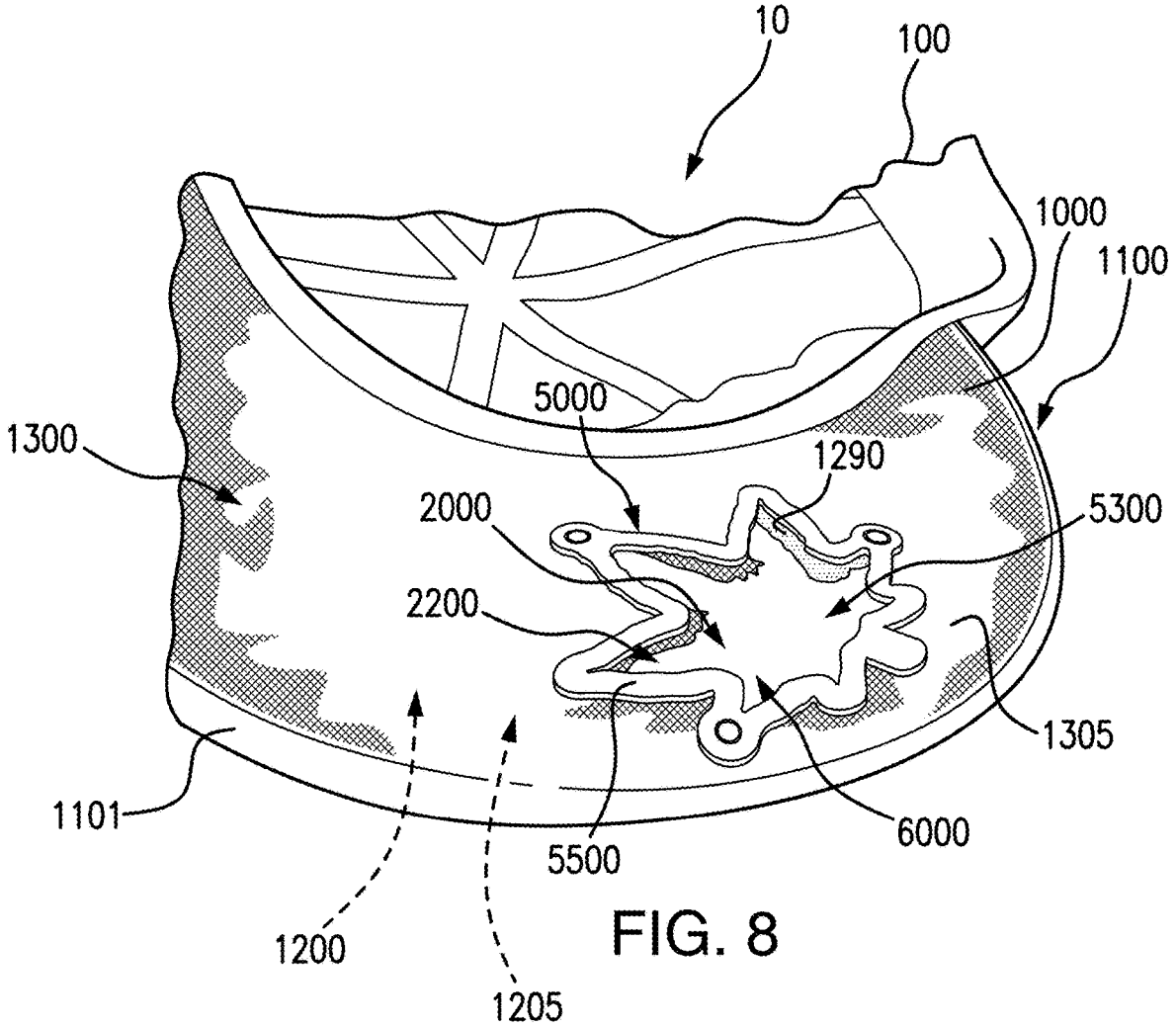
FIG. 8 shows a hat brim having a brim opening framed by a lower brim frame.

FIG. 8 shows a hat brim 1000 having a brim opening 2000 having opening shape 2200 framed by a lower brim frame 5500 having opening 6000.

Figure 9:
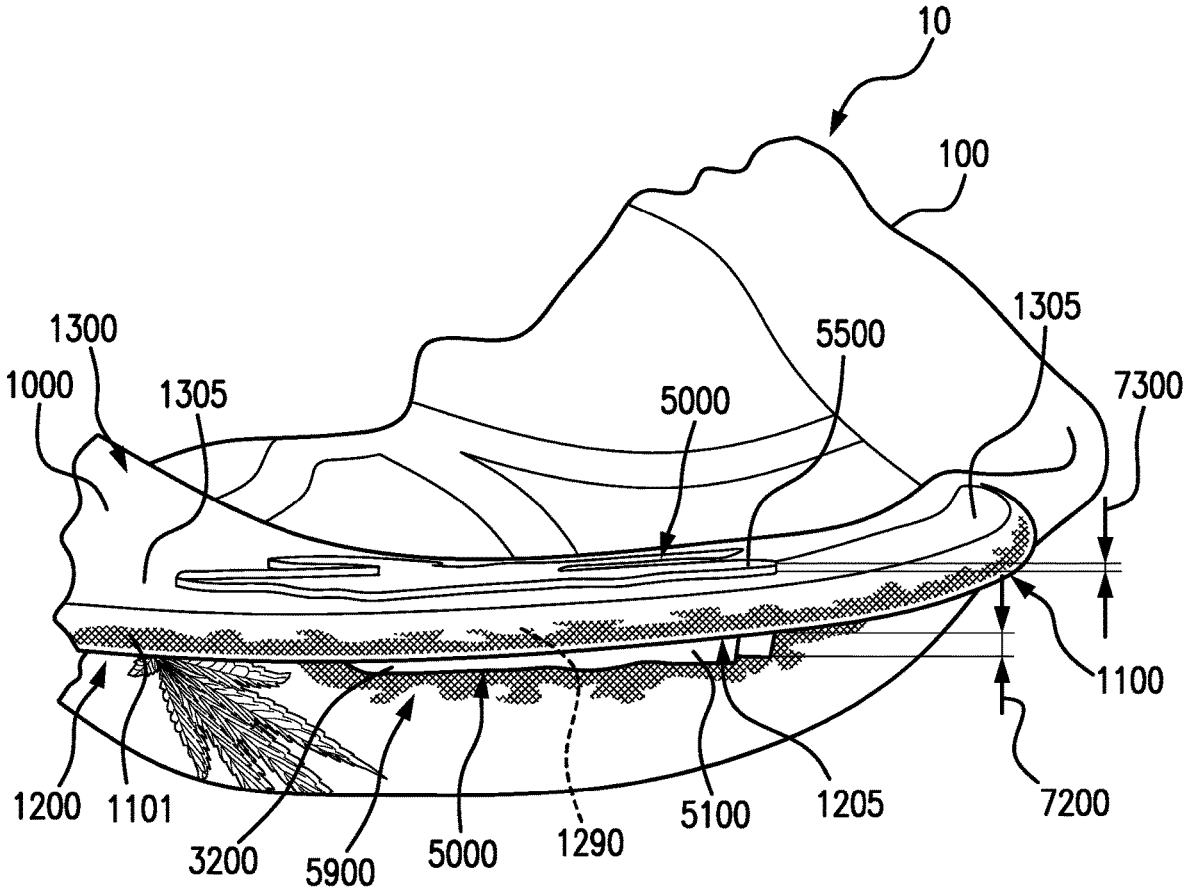
FIG. 9 is a brim edge view showing a height profile of a low-profile brim frame.

FIG. 9 is a brim edge 1101 view showing a height profile of a low-profile brim frame 5900.

As shown in FIG. 9 a brim clip height 7000 can be an upper brim clip height 7200, or a lower brim clip height 7300.

An upper brim clip height 7200 can be the height of the upper brim clip 3200 extending away from the upper layer 1205 as shown in FIG. 9. In non-limiting example the upper brim clip height can small, e.g. for a low-profile brim clip 3900 as show in FIG. 9, or can be quite high for example for artistic, creative or fashion brim clips, e.g. a brim clip with the Empire State Building, or Mountains, or Tall flowers. Thus, the upper brim clip height 7200 can be in a range of 0.025 mm to 50 cm, or higher.

A lower brim clip height 7300 can be the height of the lower brim clip 3300 extending away from the upper layer 1305 as shown in FIG. 9. In non-limiting example the lower brim clip height can small, e.g. for a low-profile brim clip 3900 as show in FIG. 9, or can be quite high for example for artistic, creative or fashion brim clips, e.g. a brim clip with a waterfall, or design columns, or long icicles. Thus, the lower brim clip height 7300 can be in a range of 0.025 mm to 50 cm, or higher.

The upper brim clip height 7200 and the lower brim clip height 7300 can be the same or different values.

The upper brim clip height 7200 and the lower brim clip height 7300 can optionally have different values at different locations.

The upper brim clip height 7200 and the lower brim clip height 7300 can be symmetrical or not symmetrical to one another. The upper brim clip height 7200 and the lower brim clip height 7300 can be symmetrical to one another in part above and below the brim and not in others. The upper brim clip height 7200 and the lower brim clip height 7300 can have certain portions that are symmetrical above and below the brim and other portions that are not symmetrical.

A low pro-file brim clip can have both an upper brim clip height 7200 which has a low-profile and a lower brim clip height 7300 which also has a low-profile. In another embodiment, one of the upper brim clip height 7200 and the lower brim clip height 7300 can be low-profile while the other is not low-profile.

Herein, the term low-profile in addition to its ordinary and customary meaning also means a brim clip height 7000 having a height dimension at its maximum height measured from an upper layer 1205 to a respective upper brim clip height 7200 maximum height, or a lower layer 1305 to the lower brim clip height 7300 maximum height, in a range of 0.01 mm-20 mm, e.g. 0.01 mm-15 mm, or 0.1 mm-10 mm, or 0.1 mm-5 mm, or 2 mm-10 mm, or 0.5 mm-5 mm, or 0.5 mm-4 mm, or 0.5 mm-2 mm, or 1 mm-3 mm, or 2 mm-4 mm; such as 2.5 mm, or 3.0 mm, or 5.0 mm, or 6.0 mm, or 7.0 mm, or 8.0 mm or 10.0 mm, or 15 mm.

Figure 10A:
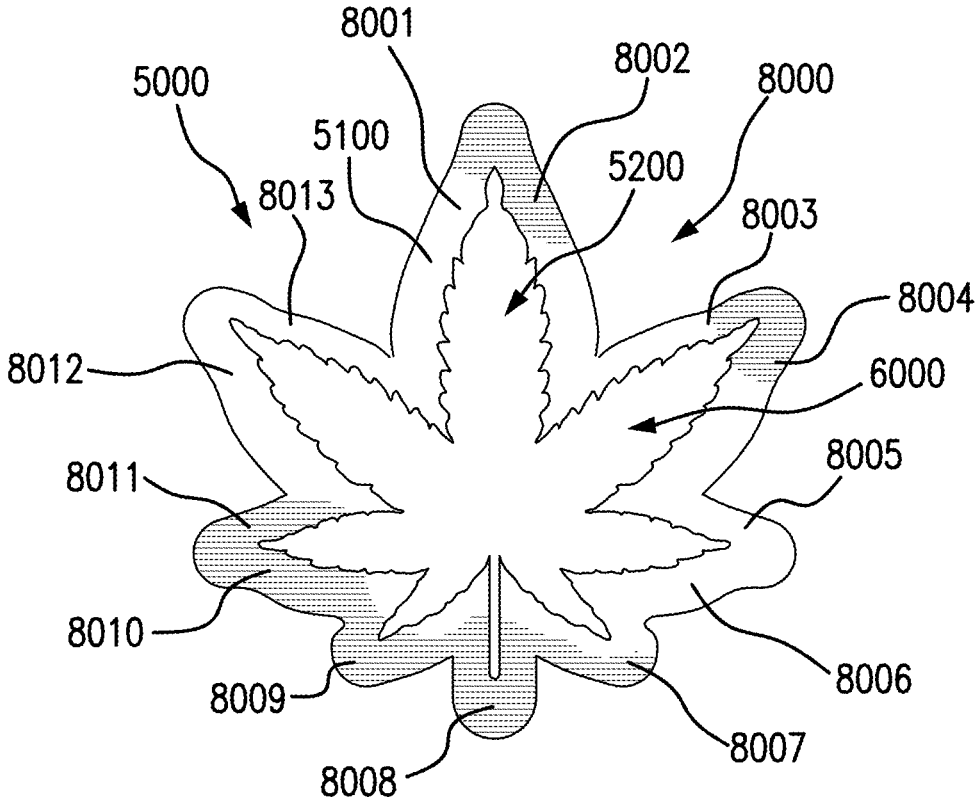
FIG. 10A shows an embodiment of an upper brim frame.
Figure 10B:
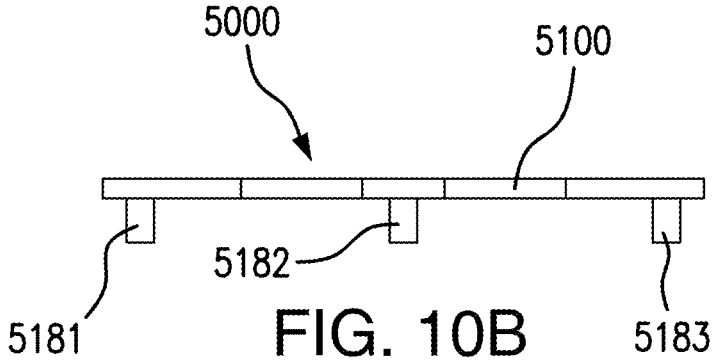
FIG. 10B shows an embodiment of upper frame pegs.
Figure 10C:
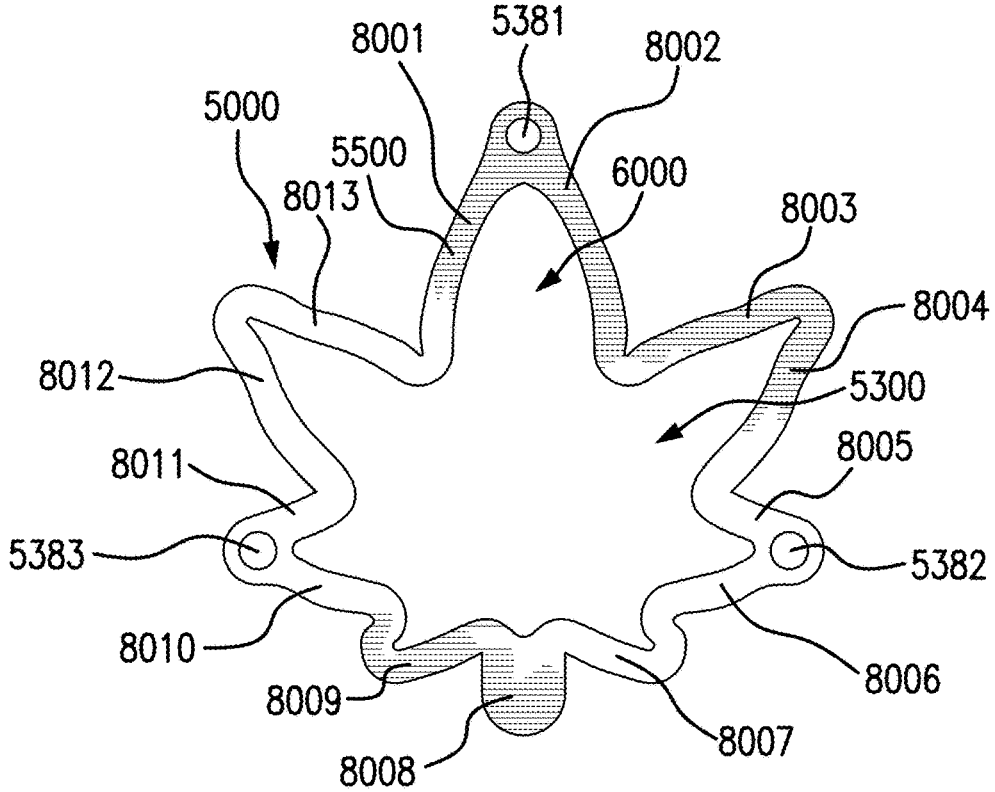
FIG. 10C shows an embodiment of a lower brim frame.

As shown in FIGS. 10A-10C, a brim frame can have a plurality of a frame segment 8000. Respective of a frame segment 8000 can be the same or different in shape, design, thickness, form, material or design. The plurality of the frame segment 8000 can be used to create a very broad variety of frame shapes. For Example the plurality of the frame segment 8000 forms the shape of a leaf, e.g. a marijuana leaf.

FIG. 10A shows an embodiment of an upper brim frame 5100 having a plurality of the frame segment 8000, e.g. $1^{st}$ frame segment 8001, $2^{nd}$ frame segment 8002, $3^{rd}$ frame segment 8003, $4^{th}$ frame segment 8004, $5^{th}$ frame segment 8005, $6^{th}$ frame segment 8006, $7^{th}$ frame segment 8007, $8^{th}$ frame segment 8008, $9^{th}$ frame segment 8009, $10^{th}$ frame segment 8010, $11^{th}$ frame segment 8011, $12^{th}$ frame segment 8012 and $13^{th}$ frame segment 8013.

FIG. 10B shows an embodiment of the upper brim frame 5100 having a plurality of an upper frame peg 5180, e.g. $1^{st}$ upper frame peg 5181, $2^{nd}$ upper frame peg 5182 and $3^{rd}$ upper frame peg 5183. Each upper frame peg can have a corresponding frame peg opening, such as $1^{st}$ lower peg opening 5381, such as $2^{nd}$ lower peg opening 5382, such as $3^{rd}$ lower peg opening 5383.

The frame pegs can extend from either, or both, of the upper brim frame 5100 and/or lower brim frame 5500. Likewise , the frame peg openings can be configured on either, or both, of the upper brim frame 5100 and/or lower brim frame 5500.

FIG. 10C shows an embodiment of an lower brim frame 5500 having a plurality of the frame segment 8000, e.g. $1^{st}$ frame segment 8001, $2^{nd}$ frame segment 8002, $3^{rd}$ frame segment 8003, $4^{th}$ frame segment 8004, $5^{th}$ frame segment 8005, $6^{th}$ frame segment 8006, $7^{th}$ frame segment 8007, $8^{th}$ frame segment 8008, $9^{th}$ frame segment 8009, $10^{th}$ frame segment 8010, $11^{th}$ frame segment 8011, $12^{th}$ frame segment 8012 and $13^{th}$ frame segment 8013.

This disclosure does not limit the number of segments, or shapes that can be formed.

Figure 10D:
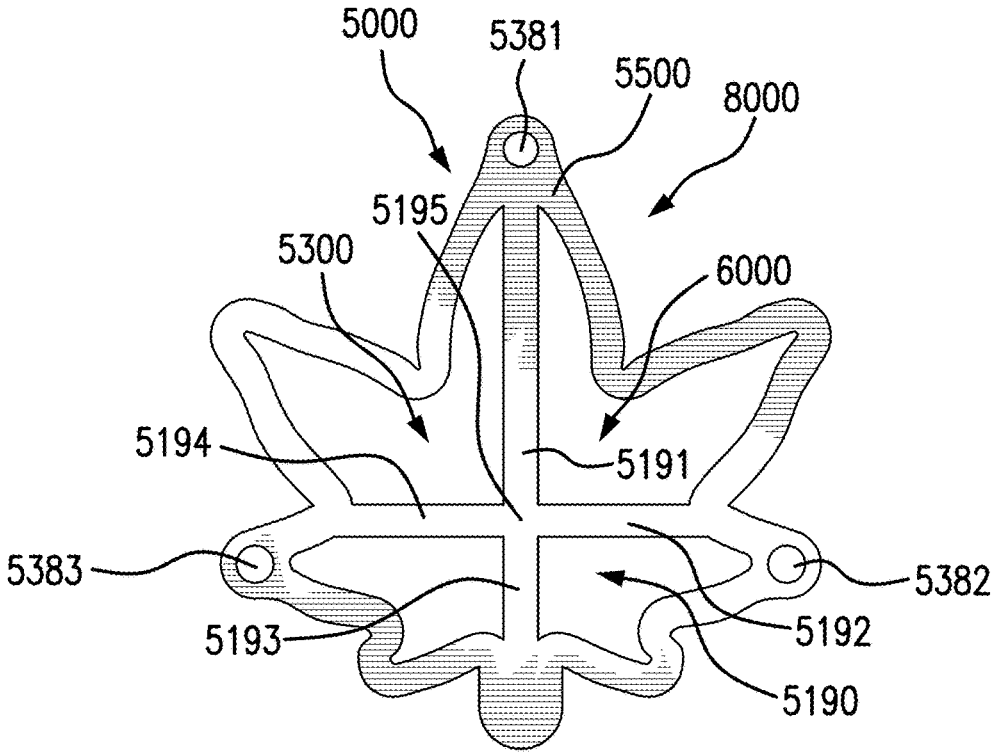
FIG. 10D shows an embodiment of a lower brim frame having a frame support.

FIG. 10D shows an embodiment of a lower brim frame 5500 having a frame support 5190, which in the example of FIG. 10 has e.g. $1^{st}$ frame support member 5191, $2^{nd}$ frame support member 5192, $3^{rd}$ frame support member 5193, $4^{th}$ frame support member 5194, frame support intersection 5195 and clip opening 5300.

This disclosure does not limit the number of support members, or the nature of their configuration and/or physical arrangement to provide support.

Figure 11:
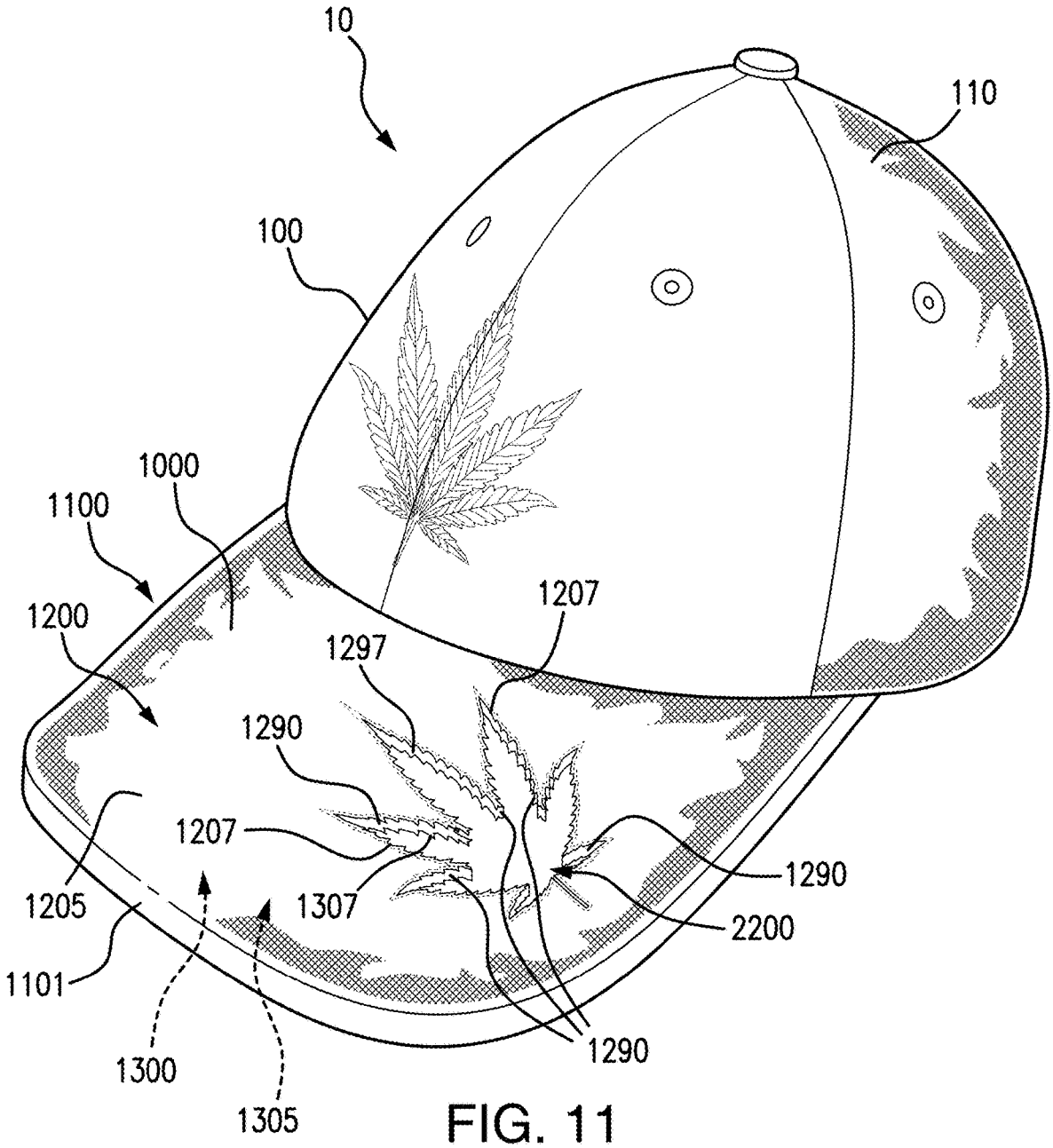
FIG. 11 shows a hat brim having a brim opening in the shape of a leaf and which is a finished brim opening and does not have a brim frame.

FIG. 11 is a perspective view of a hat 10 having a cannabis leaf cutout, according to an example of the present disclosure.

FIG. 11 shows a hat brim having a brim opening 2000 in the shape of a leaf and which is a finished brim opening and does not have a brim frame. In this embodiment, finishing of the brim opening can use a number of means such as gluing, sewing, melting, adhesives, Velcro, pressing, or other means to secure at least a portion of the upper layer 1205 and/or the lower layer 1305 to the middle layer 1290 to achieved a finished look. A wrapping member, or binding member, or a tape binding member, can be used to secure at least a portion of the upper layer 1205 and/or the lower layer 1305 to the middle layer 1290 to achieve a finished look.

FIG. 12 shows a hat having a brim opening 2000 having an opening shape 2200 in the shape of a letter "C".

Figure 13:
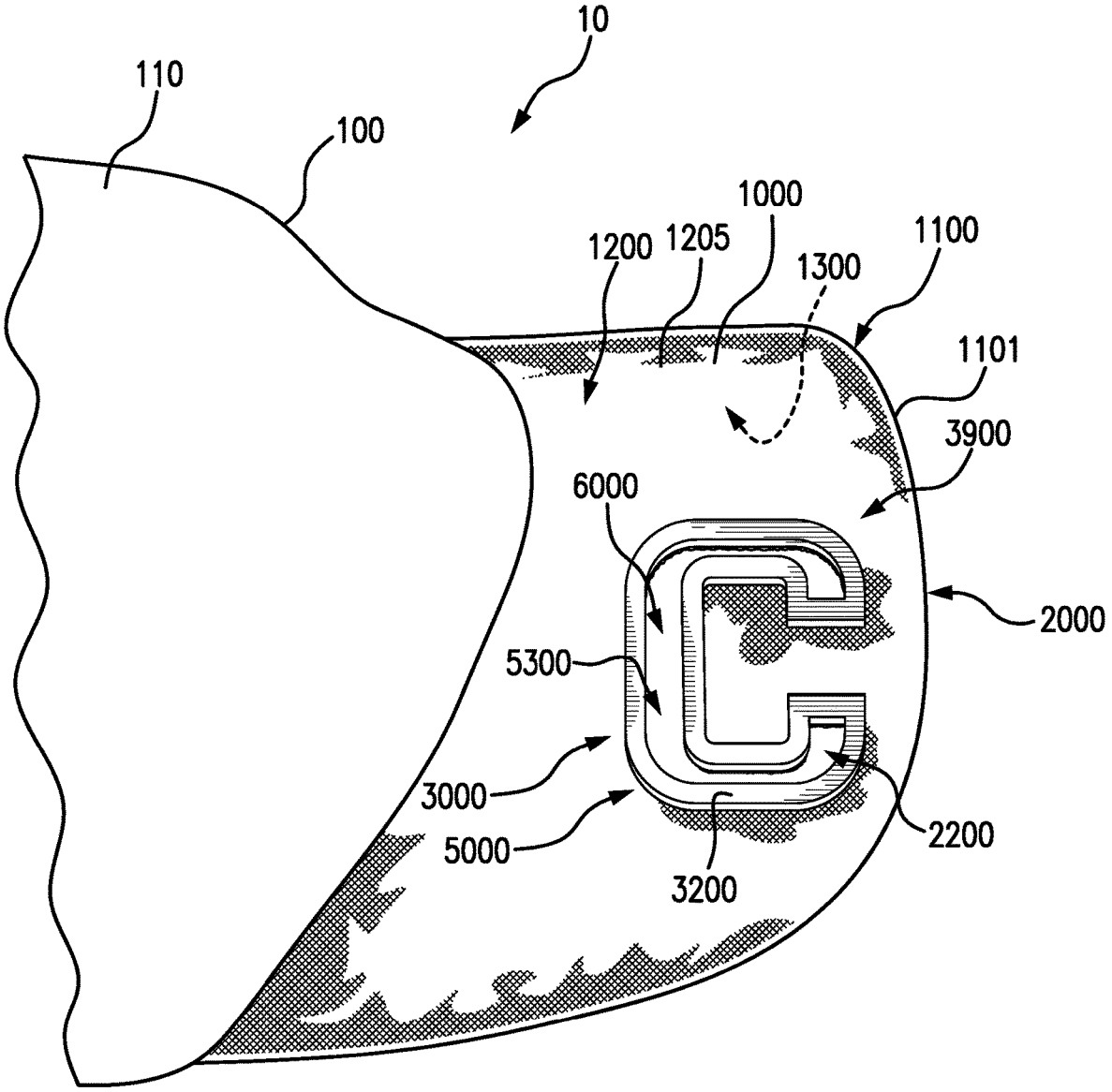
FIG. 13 shows a hat having a brim opening in the shape of a the letter "C" and having an upper brim clip.

FIG. 13 shows a hat having a brim opening 2000 having an opening shape 2200 in the shape of the letter "C" and having an upper brim clip 3200.

Figure 14:
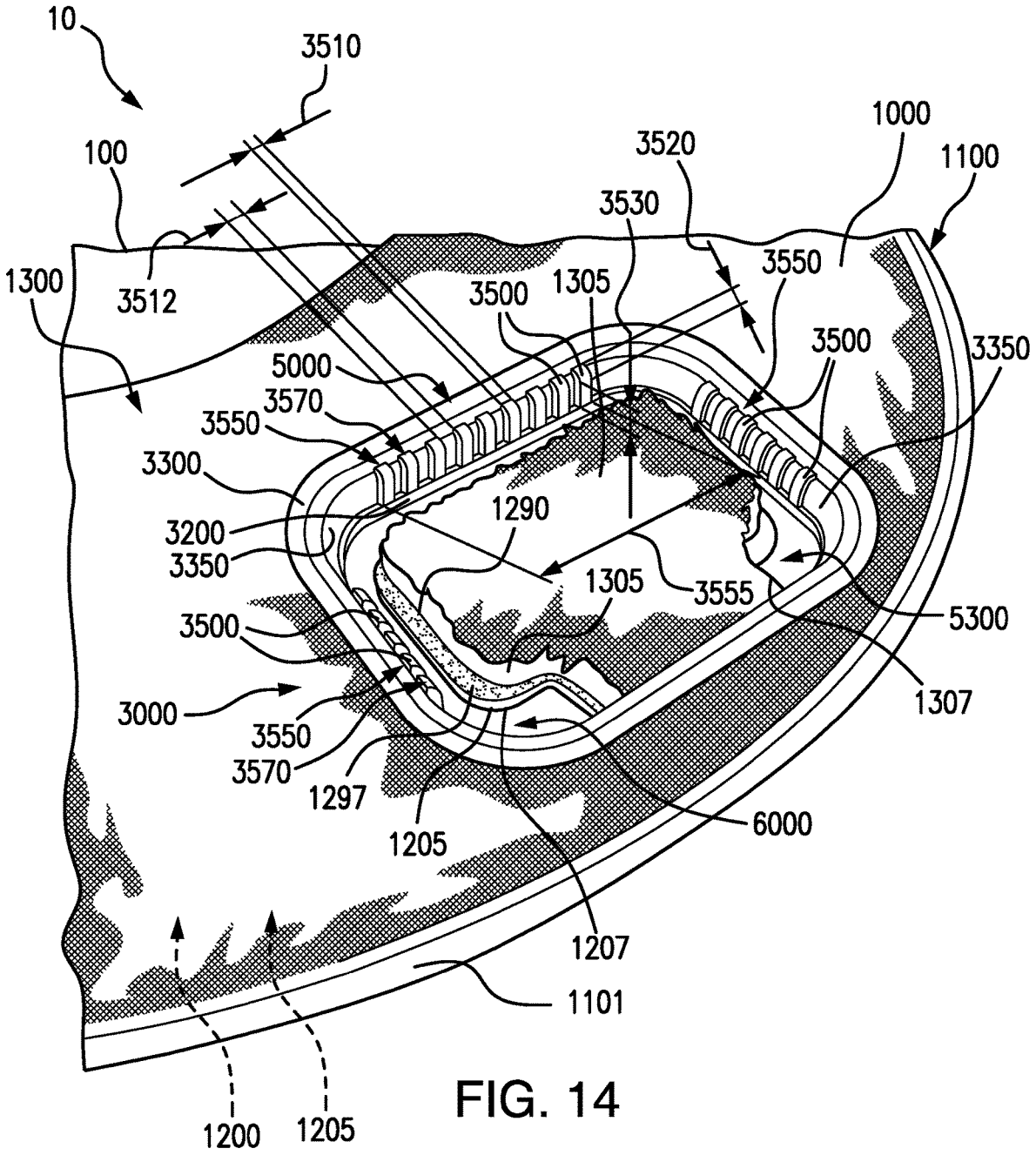
FIG. 14 shows a hat having a brim opening in the shape of a the letter "C" and having a lower brim clip.

FIG. 14 shows a hat having a brim opening 2000 having an opening shape 2200 in the shape of the letter "C" and having a lower brim clip 3300 and frame opening 6000.

The example brim clip 3000 of FIG. 14 shows a number of a brim clip comb 3550. Each brim clip comb 3550 shown has a number of a brim clip lock prong 3500.

Each brim clip 3500 lock prong has a lock prong width 3510, a lock prong depth 3520 and a lock prong height 3530.

In an embodiment, the lock prong width 3510 can be in a range of from 0.025 mm to 4 mm, or 0.01 mm-20 mm, e.g. 0.01 mm-15 mm, or 0.1 mm-10 mm, or 0.1 mm-5 mm, or 2 mm-10 mm, or 0.5 mm-5 mm, or 0.5 mm-4 mm, or 0.5 mm-2 mm, or 1 mm-3 mm, or 2 mm-4 mm; such as 1.0 mm, or 2.0 mm, or 3.0 mm, or 4.0 mm, or 5.0 mm, or 8.0 mm, or 10.0 mm, or 15.0 mm.

In an embodiment, the lock prong depth 3520 can be in a range of from 0.025 mm to 4 mm, or 0.01 mm-20 mm, e.g. 0.01 mm-15 mm, or 0.1 mm-10 mm, or 0.1 mm-5 mm, or 2 mm-10 mm, or 0.5 mm-5 mm, or 0.5 mm-4 mm, or 0.5 mm-2 mm, or 1 mm-3 mm, or 2 mm-4 mm; such as 1.0 mm, or 2.0 mm, or 3.0 mm, or 4.0 mm, or 5.0 mm, or 8.0 mm, or 10.0 mm, or 15.0 mm.

In an embodiment, the lock prong height 3530 can be in a range of from 0.025 mm to 4 mm, or 0.01 mm-20 mm, e.g. 0.01 mm-15 mm, or 0.1 mm-10 mm, or 0.1 mm-5 mm, or 2 mm-10 mm, or 0.5 mm-5 mm, or 0.5 mm-4 mm, or 0.5 mm-2 mm, or 1 mm-3 mm, or 2 mm-4 mm; such as 1.0 mm, or 2.0 mm, or 3.0 mm, or 4.0 mm, or 5.0 mm, or 8.0 mm, or 10.0 mm, or 15.0 mm, or 20 mm.

Each brim clip comb 3550 has a clip comb length 3555 along which one or more of the brim clip 3500 can be configured.

In an embodiment, the clip comb length 3555 can be in a range of 0.01 mm-50 mm, e.g. 0.01 mm-25 mm, or 0.1 mm-20 mm, or 0.1 mm-10 mm, or 2 mm-15 mm, or 0.5 mm-5 mm, or 5 mm-12 mm, or 0.5 mm-8 mm, or 1 mm-16 mm, or 2 mm-9 mm; such as 5 mm, or 10 mm, or 15 mm, or 20 mm, or 25 mm, or 30 mm, or 40 mm, or 50 mm.

Figure 15:
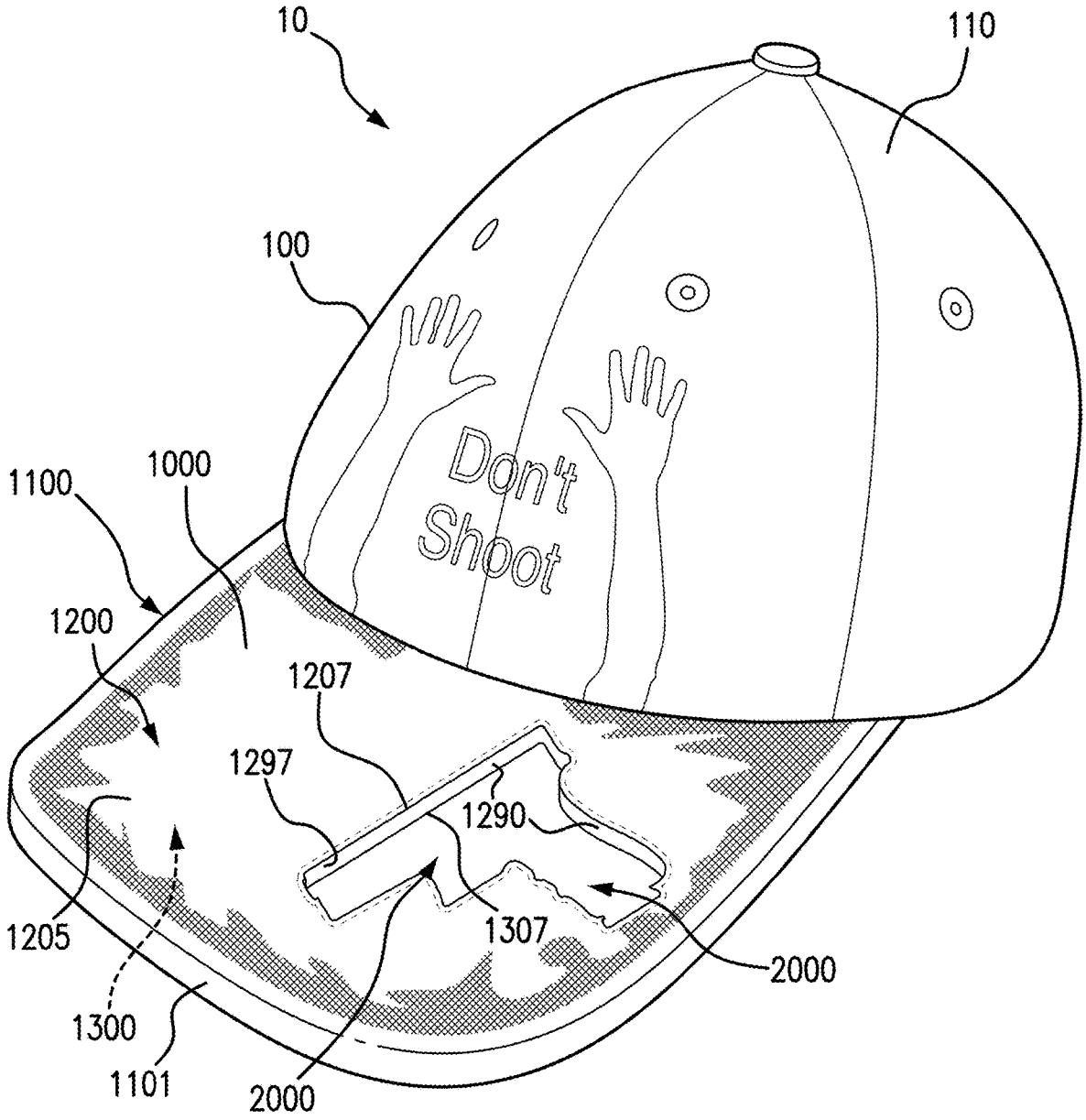
FIG. 15 shows a hat brim having a brim opening in the shape of a gun and which is a finished brim opening and does not have a brim frame.

FIG. 15 shows a hat brim having a brim opening in the shape of a gun and which is a finished brim opening and does not have a brim frame. FIG. 15 is a perspective view of a hat 10 having a gun-shape cutout, according to an example of the present disclosure.

In an embodiment, a hat, e.g. a baseball cap, having a hat brim 1000 having three layers of material in which at least the material constituting the respectively middle layer 1290 of each hat brim 1000 are different.

In an embodiment, an installed brim clip 3000 framing the brim opening 2000 perimeter of the brim opening 2000.

In an embodiment, a hat, e.g. a baseball cap, having a hat brim 1000 having a brim opening 2000 in the shape of a "C" that has an opening perimeter.

In an embodiment, an installed brim clip 3000 framing the brim opening 2000 perimeter of the brim opening 2000 in the shape of a "C".

The brim opening 2000 shape 2200 can have an opening perimeter 2300. The brim opening 2000 perimeter can have one or more segments and can take any shape. A brim opening 2000 can also have a brim perimeter 2300.

The nonlimiting example of a brim opening 2000 in FIG. 6 penetrates through one or more layers of a hat brim 1000 and passes fully through the hat brim 1000 creating a brim passageway 2010. The brim passageway 2010 can extend from an upper brim portion 1200 through the hat brim 1000 to an upper brim portion 1300 and can pass through all brim layers of material.

As shown in the example of FIGS. 3-6 creating the brim opening 2000 destroys the structure of the brim causing portions of the brim material layers, e.g. upper layer 1205 and lower layer 1305, to separate from the middle layer 1290 ruining the hat brim 1000. The brim opening 2000 can be created by cutting, laser cutting, water cutting, stamping, tearing, or other means. The brim opening 2000 can be formed into one or more brim layers as the layers are created or before, or in conjunction, with constructing the brim itself. The non-limiting example of FIG. 6 has three material layers that constitute the brim, e.g.:

a $1^{st}$ layer (first layer), which for example can be an upper layer 1205 having an upper layer perimeter 1207;

a $2^{nd}$ layer (second layer), which for example can be a middle layer 1290 having a middle layer perimeter, or support layer; and a 3rd layer (third layer), which for example can be a lower layer 1305 having a lower layer perimeter 1307.

There are no limits to the number of layers that constitute the brim. There is also no limit to the variety of shape of the brim opening 2000 which is framed. Additionally, the brim may have a laminate structure of layers or can have a non-laminated structure of layers.

FIGS. 2-9 and 11-15 show images of a hat, e.g. a baseball cap, having a hat brim 1000 having three layers of material in which at least the materials of the middle layer 1290 are different from one or more of the adjacent layers. In the embodiment the three layers are sown together forming the hat brim 1000. When the brim opening 2000 is formed the layered structure of the hat brim 1000 is destroyed.

This disclosure is not limited regarding the number of layers that can compose the brim.

FIGS. 13-14 shows images of an installed brim clip 3000 framing the brim opening 2000 perimeter of the brim opening 2000.

In its many and varied embodiments, the hat brim technology can frame one or more brim opening 2000 in a hat brim 1000. A brim clip 3000 which engages at least a portion of a brim opening 2000 and which can optionally secure a plurality of the brim material layers when in an installed state. A method for creating a framed brim opening 2000 in a hat brim 1000.

In an embodiment, a hat can have a hat brim 1000 having a brim opening 2000, said brim opening 2000 having an upper layer perimeter 1207 and an upper brim clip 3200 portion which frames at least a portion of said upper layer perimeter 1207.

In an embodiment, e.g. 13 or 14, a lower brim clip 3300 portion which frames at least a portion of a lower layer perimeter 1307 of said opening. The lower brim clip 3300 portion can frame at least a portion of a lower layer perimeter 1307 of said opening and which at least in part secures said upper layer perimeter 1207 in position in relation to the upper layer perimeter 1207. In an embodiment, the upper brim clip 3200 portion and lower brim clip 3300 portion can be secured by a fastening means, such as rivets, screws, bolts, or other means. A broad variety of means can be used by which a lower brim clip 3300 portion can at least in part secure said upper brim clip 3200 in position in relation to the upper layer perimeter 1207.

Further, an upper brim clip 3200 portion can at least in part secure an upper layer 1205 in position in relation to a different layer. Additionally, a lower brim clip 3300 portion can at least in part secure said upper brim clip 3200 in position in relation to the upper layer perimeter 1207.

In an embodiment, the lower brim clip 3300 portion can at least in part secure said upper brim clip 3200 in position in relation to said upper layer perimeter 1207; and the upper brim clip 3200 portion and said lower brim clip 3300 portion can secure a plurality of layers of material of said hat brim 1000 in position in regard to one another.

The middle layer can have a middle layer perimeter 1297.

FIGS. 3, 4, 5, 6, 12 and 14 show a deformation of at least a portion of a hat brim 1000 resulting from the formation of a brim opening 2000 that destroyed the structure of the brim.

FIGS. 3, 4, 5, 6, 12 and 14 show a separation of layers which results from the formation of the brim opening 2000.

FIGS. 13-14 shows images of an installed brim clip 3000 with clip opening 5300 framing the brim opening 2000 perimeter of the brim opening 2000.

As shown in FIG's 13-14, in an embodiment, hat brim clip 3000 can have an upper brim clip 3200 portion configured adjacent to an upper brim portion 1200 and a lower brim clip 3300 portion configured adjacent to an upper brim portion 1300, and said upper brim clip 3200 portion and said lower brim clip 3300 portion secured in position in relation to one another by at least one lock prong. A plurality of lock prongs can be used. In an embodiment, the lock prongs can be configured in the form of a locking comb having prong separation 3512.

FIG. 14 is an angle view showing a plurality of lock prongs securing the upper brim clip 3200 and lower brim clip 3300 together. FIG. 14 shows that each respective lock prong 3500 can have a portion bent to grip at least a portion of the lower brim clip 3300. In an embodiment, each respective lock prong 3500 can be crimped to secure at least a portion of the upper brim clip 3200 and at least a portion of the lower brim clip 3300 together.

Lock prongs can be the same or different. As shown in FIG. 14, a first lock prong can be different from a second lock prong. In an embodiment, one or more lock prongs can extend from the upper brim clip 3200. In an embodiment one or more lock prongs can extend from the lower brim clip 3300. In an embodiment, one or more lock prongs can extend from each of the upper brim clip 3200 and the lower brim clip 3300 In yet another embodiment, the lock prongs can be interlocking.

In an embodiment, a lower brim clip 3300 portion having a lock surface that is engaged with a lock prong when in an installed state in a hat brim 1000. In another embodiment, a lock prong 3500 can have a have a lock angle forming a lock claw portion 3570 of the lock prong 3500. The lock claw 3570 can engage a least a portion of the lock surface 3550 when in an installed state in a hat brim 1000.

As shown in FIGS. 13-14, optionally, at least a portion of said upper brim clip 3200 has a different shape than at least a portion of said lower brim clip 3300.

In a non-limiting example embodiment, a method for producing a framed brim opening 2000, can have the steps of: providing a hat having a hat brim 1000; cutting an opening in the hat brim 1000 in which said cutting creating an opening having a shape and an upper layer perimeter 1207; providing an upper brim frame 5000 having at least a portion of which is configured adjacent to the upper layer perimeter 1207; securing the upper brim frame 5000 adjacent to an upper portion of the upper brim; and said securing producing a framed hat brim opening 2000.

In an embodiment, the hat brim 1000 can have a number of material layers.

In another embodiment, the method for producing a framed brim opening 2000 can further have the steps of providing a lower brim frame 5000; and configuring said lower brim frame 5000 adjacent to a lower portion of said brim. Optionally, the shape of the upper brim frame 5000 and the lower brim frame 5000 can be different at least in part. Additionally, optionally the shape of the upper brim frame 5000 and the upper layer perimeter 1207 can be different at least in part.

In an embodiment, the brim frame 5000 for a hat opening can have a frame portion configured adjacent to a brim portion which frames at least a portion of a brim opening 2000.

The frame portions can have a broad variety of shapes and designs, can be low-profile or tall, and can be of many shapes, sizes and forms.

In an embodiment, the brim opening 2000 can have a shape which accepts the reversible attachment of a broad variety of frames, which optionally can be interchangeable.

In another embodiment, the brim clip 3000 can accept the reversible attachment of a broad variety of frames to at least a portion of the brim clip 3000, which optionally can be interchangeable.

In yet another embodiment, the brim can have a fastening system, or one or more fasteners, that can accept the reversible attachment of a broad variety of frames to at least a portion of the brim clip 3000, which optionally can be interchangeable In its broad and varied embodiments, disclosed herein can be a cap, the cap can include an optional top button; a plurality of panels, an eyelet on each of the plurality of panels, and a brim. Generally, the plurality of panels can include two front panels, two side panels, and two back panels.

In an example, the brim can have a brim opening 2000 in a shape of an advertisement, a logo, a design, a statement, a phrase, an emblem of a sports team, company, or organization. As shown in FIG. 15, the shape of the brim opening 2000 can be substantially similar to a shape of a handgun. In another example, as shown in FIG. 11, the shape of the brim opening 2000 can be substantially similar to a shape of a cannabis leaf.

In an embodiment, the brim opening 2000 can be positioned off-center of the brim. Furthermore, the brim opening 2000 can include a depth that is the same as the thickness of the brim. Accordingly, light can enter the brim opening 2000 at the top portion of the brim and exit the brim at the bottom portion of the brim.

In an example, the brim can create a shaded area that covers at least a portion of the user's face. Given that the brim opening 2000 extends all the way though the thickness of the brim 108, when the light passes though the brim opening 2000, it can reflect the shape of the brim opening 2000 on the face of the user.

Hat brim frames can be permanently or reversibly attached to a hat brim opening and/or a hat brim by a variety of means including but not limited to Velcro, snaps, magnets, adhesives, lock and key mechanisms, staples, fasteners or other affixing members.

The frames can also have a frame opening shape which overlays the brim opening and thus the frame opening shape is what provides the visual opening seen by one looking at the upper brim. Thus, the brim opening can be easily manufactured and one or more different frame opening shapes can be permanently, or reversibly, attached to the brim to provide a desired frame opening shape overlaid upon the existing or standard brim opening.

In an embodiment a system of frames having frame openings can be provided which could respectively be added or removed from the brim.

In another embodiment a kit can be provided which contains a number of frame members having different frame opening.

In yet another embodiment a kit can be provided which contains a number of frame members adapted to be assembled to achieve a desired frame opening, or a variety of frame openings.

In an embodiment, the panels can include at least one an advertisement, a logo, a design, a statement, a phrase, an emblem of a sports team, company, or organization. In another embodiment, the panels can include a design and a statement or a phrase that is related to the brim opening 2000. For example, in an embodiment the brim opening 2000 can include a shape of a handgun and optionally the design and phrase on the front panels 106A can be two arms sticking up and the phrase "Don't Shoot." In another example, a design on the front panel, or panels, can be substantially similar to the design of the brim opening 2000. For example, if the design of the brim opening 2000 includes a shape of a cannabis leaf, optionally the design on the front panel, or panels, can be a cannabis leaf as well.

This disclosure regards a hat brim technology and its many aspects, features and elements. Such an apparatus can be dynamic in its use and operation. This disclosure is intended to encompass the equivalents, means, systems and methods of the use of the tape measure and its many aspects consistent with the description and spirit of the apparatus, means, methods, functions and operations disclosed herein. Other embodiments and modifications will be recognized by one of ordinary skill in the art as being enabled by and within the scope of this disclosure.

The scope of this disclosure is to be broadly construed. The embodiments herein can be used together, separately, mixed or combined. It is intended that this disclosure disclose equivalents, means, systems and methods to achieve the devices, designs, operations, control systems, controls, activities, mechanical actions, dynamics and results disclosed herein. For each mechanical element or mechanism disclosed, it is intended that this disclosure also encompasses within the scope of its disclosure and teaches equivalents, means, systems and methods for practicing the many aspects, mechanisms and devices disclosed herein. The claims of this application are likewise to be broadly construed.

The description of the technology herein in its many and varied embodiments is merely exemplary in nature and, thus, variations that do not depart from the gist of the disclosure are intended to be within the scope of the claims and the disclosure herein. Such variations are not to be regarded as a departure from the spirit and scope of the disclosed technologies.

It will be appreciated that various modifications and changes can be made to the above described embodiments of the hat brim technology as disclosed herein without departing from the spirit and the scope of the claims.

We claim:

1. A device, comprising:

a first frame portion having at least one of a first frame portion locking comb;

a second frame portion having a second frame portion opening and at least one of a second frame portion lock surface; and said at least one of a first frame portion locking comb is configured to comprise a plurality of first frame portion locking comb lock prongs, each of said plurality of first frame portion locking comb lock prongs have a first frame portion locking comb lock prong height that extends away from said first frame portion to a first frame portion locking comb lock prong lock angle forming a first frame portion locking comb lock claw portion, wherein said first frame portion locking comb lock claw portion of each of said plurality of first frame portion locking comb lock prongs of said at least one of a first frame portion locking comb of said first frame portion configured to extend into said second frame portion opening and engage said at least one of a second frame portion lock surface of said second frame portion thereby locking said first frame portion to said second frame portion.

2. A device according to claim 1, further comprising:

said a first frame portion having a plurality of first frame portion locking combs of said at least one of said first frame portion locking comb; and said second frame portion having a plurality of second frame portion lock surfaces of said at least one of a second frame portion lock surface.

3. A device according to claim 1, further comprising:

said first frame portion having a first frame portion opening and at least one of a first frame portion lock surface;

said a second frame portion having at least one of a second frame portion locking comb; and said at least one of a second frame portion locking comb is configured to comprise a plurality of second frame portion locking comb lock prongs, each of said plurality of second frame portion locking comb lock prongs have a second frame portion locking comb lock prong height that extends away from said second frame portion to a second frame portion locking comb lock prong lock angle forming a second frame portion locking comb lock claw portion, wherein said second frame portion locking comb lock claw portion of each of said plurality of second frame portion locking comb lock prongs of said at least one of a second frame portion locking comb of said second frame portion configured to extend into said first frame portion opening and engage said at least one of a first frame portion lock surface of said first frame portion thereby locking said first frame portion to said second frame portion.

* * * * *